US005106072A

United States Patent [19]

Sugiura et al.

[11] Patent Number: 5,106,072

[45] Date of Patent: Apr. 21, 1992

[54] SHEET FEEDING DEVICE

[75] Inventors: Toshiaki Sugiura, Hekinan; Shigeo Ishikawa, Hazu; Hiroshi Tokuda, Nagoya; Hikaru Kaga, Ama, all of Japan

[73] Assignee: Brother Kogyo Kabushiki Kaisha, Aichi, Japan

[21] Appl. No.: 642,512

[22] Filed: Jan. 17, 1991

Related U.S. Application Data

[62] Division of Ser. No. 404,904, Sep. 8, 1989, abandoned.

[30] Foreign Application Priority Data

Sep. 13, 1988 [JP] Japan ..... 63-229053

[51] Int. Cl.[5] ..... B65H 3/06

[52] U.S. Cl. ..... 271/117; 271/109; 271/127

[58] Field of Search ..... 271/109, 117, 127, 171

[56] References Cited

U.S. PATENT DOCUMENTS

| | | | |
|---|---|---|---|
| 4,098,501 | 7/1978 | Tanijet et al. | 271/117 |
| 4,351,519 | 9/1982 | Jendrick | 271/117 |
| 4,478,401 | 10/1984 | Shibaya | 271/127 |
| 4,577,850 | 3/1986 | Takeyama et al. | 271/127 |
| 5,060,927 | 10/1991 | Sugiura | 271/117 |

FOREIGN PATENT DOCUMENTS

| | | | |
|---|---|---|---|
| 2229 | 6/1979 | European Pat. Off. | 271/117 |
| 113534 | 4/1978 | Japan | 271/117 |
| 48335 | 5/1981 | Japan | 271/117 |
| 47734 | 3/1983 | Japan | 271/117 |
| 113045 | 7/1983 | Japan | 271/117 |
| 212334 | 12/1984 | Japan | 271/109 |
| 19627 | 1/1985 | Japan | 271/109 |
| 19628 | 1/1985 | Japan | 271/109 |
| 242140 | 12/1985 | Japan | 271/9 |
| 2632 | 1/1986 | Japan | 271/117 |
| 162435 | 7/1986 | Japan | 271/117 |
| 106246 | 5/1988 | Japan | 271/127 |
| 310219 | 12/1990 | Japan | 271/117 |

*Primary Examiner*—Robert P. Olszewski
*Assistant Examiner*—Steven M. Reiss
*Attorney, Agent, or Firm*—Kane, Dalsimer, Sullivan, Kurucz, Levy, Eisele and Richard

[57] ABSTRACT

A sheet feeding device includes a member for depressing a pair of rollers to feed the top sheet off a stack of papers in a case. The depressing member is only operated when the case is positioned in an associated device. The spacing between the feed rollers is variable and controlled in accordance with the width of the stacked sheets.

11 Claims, 5 Drawing Sheets

SHEET FEEDING DEVICE

This is a divisional of copending application Ser. No. 07/404,904 filed on Sep. 8, 1989 now abandoned.

BACKGROUND OF THE INVENTION

The present invention relates to a sheet feeding device for feeding print sheet or copy sheet to a printer unit of a printing machine or a duplicator unit of a duplicating machine one by one, and more particularly, to a device in which a plurality of sheets are held in a stacked state within a cassette case, capable of being temporarily depressed when the case is attached to the machine or detached from it, while the positions for depressing operation and the positions of a pair of rollers for feeding the sheet are simultaneously and automatically changeable in accordance with a width of the sheet stacked in the case.

In the cassette type sheet feeding device as mentioned above, bundles of sheet which are different in size, sheet material and sheet type, are stored in separate cassette cases. Those different cassette cases are loaded into the machine body alternatively as required to supply the machine with a desired type of sheet. This type of device is recently widely used because of handiness. This cassette type device has a case insertion compartment provided in the body of the printer or duplicating machine, into which the cassette case carrying stacked sheets is loaded. There are different versions of such cassette type sheet feeding device, one of which has a sheet feed roller and a separator lug.

In more particular, the sheet feed roller is located at the case insertion compartment to feed the sheet forward by its rotational movement in contact with the top sheet of the stacked sheets. The sheet feed roller is carried by a roller shaft provided in the case insertion compartment, which shaft in turn extends transversely across the case compartment substantially at right angles to the direction in which the cassette case is inserted.

On the other hand, the cassette case is provided with a lifting member carrying the underside of the bottom sheet for movement in the direction in which the sheets are stacked. The lifting member is biased by a predetermined biasing member toward the sheet feed roller so that the top sheet is pressed against the feed roller. The cassette case is further provided with a separator lug mentioned above. The separator lug is located at each corner of the front end of the sheet held in stack in the cassette case in the feed direction thereof to engage at least the front and side of the sheet. During feed operation of the sheet feed roller, the top sheet is at its each corner deformed to a curve to allow the top sheet alone to exit. The separator lug is carried by a lug support member which is movable substantially in the same direction as the stacking direction of sheets.

This process of separating and feeding the sheet one by one by means of a separator lug taking advantage of flexibility of the sheet is generally called a lug-separating sheet flexing method.

When loading and unloading of the cassette case in the device mentioned above, if the stacked sheets in the cassette case are brought into contact with the sheet feed roller at the case insertion compartment, the sheet tends to crease, bend, or to be missplaced in the cassette case or will be subject to other inconveniences. It is therefore necessary to keep the sheet and the sheet feed roller out of contact with each other when loading and unloading the cassette case.

To overcome this problem, there has been proposed such an arrangement that the sheet feed roller is movable between a contact position in which it is in contact with the top sheet in the cassette case and a withdrawn position in which it is apart from the contact position at a certain distance, wherein the sheet feed roller is brought into contact with the sheet only during feed operation.

There has also been a proposed arrangement in which part of the outer circumference of the feed roller is cut away in plane to provide a D profile. Thus, the plane surface normally opposes to the top sheet in the cassette case at a certain distance therefrom to avoid contact therewith, while in feeding operation, the cylindrical portion of the D-shaped roller is brought into contact with the top sheet to feed it out.

The former arrangement of moving the feed roller, however, requires a mechanism for movably carrying the feed roller and an extra driving member for driving it, resulting in a complicated structure and therefore an added cost and failuer probability.

In the latter arrangement with a D-shaped feed roller, a steady control of the feed roller home position in which the cutaway plane opposes to the sheet is required, providing one cause of added expense. Also, a certain stroke of feeding movement must be done with the cylindrical portion of the D-shape, requiring a large-size roller. Furthermore, if there are two feed rollers provided, the D cut shape may be different between the two rollers, which will cause skewed feeding, i.e., the sheet being fed out at a slight angle to the horizontal plane.

The lug-separating type sheet feeding device as mentioned above is often provided with feed rollers in pair which are located inside the both sides of the bundle of sheet at a certain distance therefrom. In this case, feeding errors such as sheet jam, double feed and blank feed are apt to occur unless the side face of the sheet is kept at an optimum distance from each sheet feed roller.

In the cassette type sheet feeding device, usually employed a plurality of cassettes for different sheet sizes. In many cases, those multiple cassettes, each carrying stacked sheets of certain size, are alternatively inserted into a common case insertion compartment provided in the body of printer or duplicating machine or the like. In this type of device, the sheet width is changed with every replacement of cassette case. To cope with this change, it is desirable to keep the roller position constant with respect to the both sides of the paper regardless of varying sheet widths.

To this end, there has been a conventional arrangement in which multiple sheet feed rollers in pairs are fixedly mounted on the roller shaft, each pair being located at a distance corresponding to a certain sheet width from each other. In sheet feeding, the pair corresponding to the selected sheet width is picked out of the multiple sheet feed rollers and is brought into engagement with the sheet near the both sides thereof. Here, in order to allow the common case insertion compartment to be shared by as many as sheet sizes as possible, it is necessary to provide as many sheet feed rollers as possible on the roller shaft.

When the above embodiment is to be applied to such configuration of the feeding device, it is difficult to give an enough space for the press-down operating member between those sheet feed rollers on the roller shaft.

More specifically, each cassette case usually has a pair of lug support members spaced in accordance with the sheet size on both sides of the sheet, which are movable substantially in the same direction as the sheet stacking direction. The separator lugs are born by those lug support members so that the distance between the pair of support members is changed with change of sheet sizes. To handle this situation, the press-down operating members must be provided in pairs corresponding to the number of sheet sizes, requiring a considerable space to accommodate such multiple press-down operating members. This would then make it necessary to widen the distance between the multiple feed rollers, resulting in a limited number of sheet feed rollers to be mounted on the roller shaft. As a result, the number of cassette cases sharing one case insertion compartment, i.e., the number of sheet sizes will be limited.

SUMMARY OF THE INVENTION

It is therefore an object of the invention to provide an improved sheet feedng device capable of preventing abnormalities in sheet feed with a simple structure during loading and unloading a cassette case holding a plurality of sheets in a stacked state.

Another object of the invention to provide an improved sheet feeding device which allows itself to use as many sheet widths as possible when one case insertion compartment is shared by more than one cassette cases with different sheet sizes, while effecting proper feeding operation and preventing sheet abnormalities during loading and unloading the cassette.

For this purpose, according to one aspect of the invention, there is provided a sheet feeding device provided in a recording device, comprising a case member for holding a plurality of the recording sheets in a stacked state, a pair of feed rollers coaxially provided on a shaft member located above the stacked sheets, for feeding the sheet located on the top of the stacked sheets, the sheet feeding device further comprises: a pair of sheet separation members provided on the case member having a pair of nail portions for separating the sheet having been located on the top of the stacked sheets in accordance with a sheet feed operation of the pair of feed rollers; first control means for controlling the stacked sheets in such a manner that the sheet located on the top of the stacked sheets is brought into contact with the pair of feed rollers; and second control means for controlling the first control means so as not to be operated in case that a positional relationship between the case member and the recording device becomes a predetermined state.

According to another aspect of the invention, there is provided a sheet feeding device provided in a recording device, comprising a case member for holding a plurality of recording sheets in a stacked state, a pair of feed rollers coaxially provided with a variable interval of length on a shaft member located above the stacked sheets, for feeding the sheet located on the top of the stacked sheets, the sheet feeding device further comprises: a pair of sheet separation members provided on the case member having a pair of nail portions for separating the sheet having been located on the top of the stacked sheets in accordance with a sheet feed operation of the pair of feed rollers; first control means for controlling the stacked sheets in such a menner that the sheet located on the top of the stacked sheets is brought into contact with the pair of feed rollers; second control means for controlling the first control means so as not to be operated in case that a positional relationship between the case member and the recording device becomes a predetermined state; and third control means for controlling the interval of length of the pair of feed rollers so as to be varied in accordance with a width of the sheets stacked in the case member.

DESCRIPTION OF THE ACCOMPANYING DRAWINGS

DESCRIPTION OF THE EMBODIMENTS

The first embodiment of the present invention, will be described below with reference to the accompanying drawings.

Figure 1:
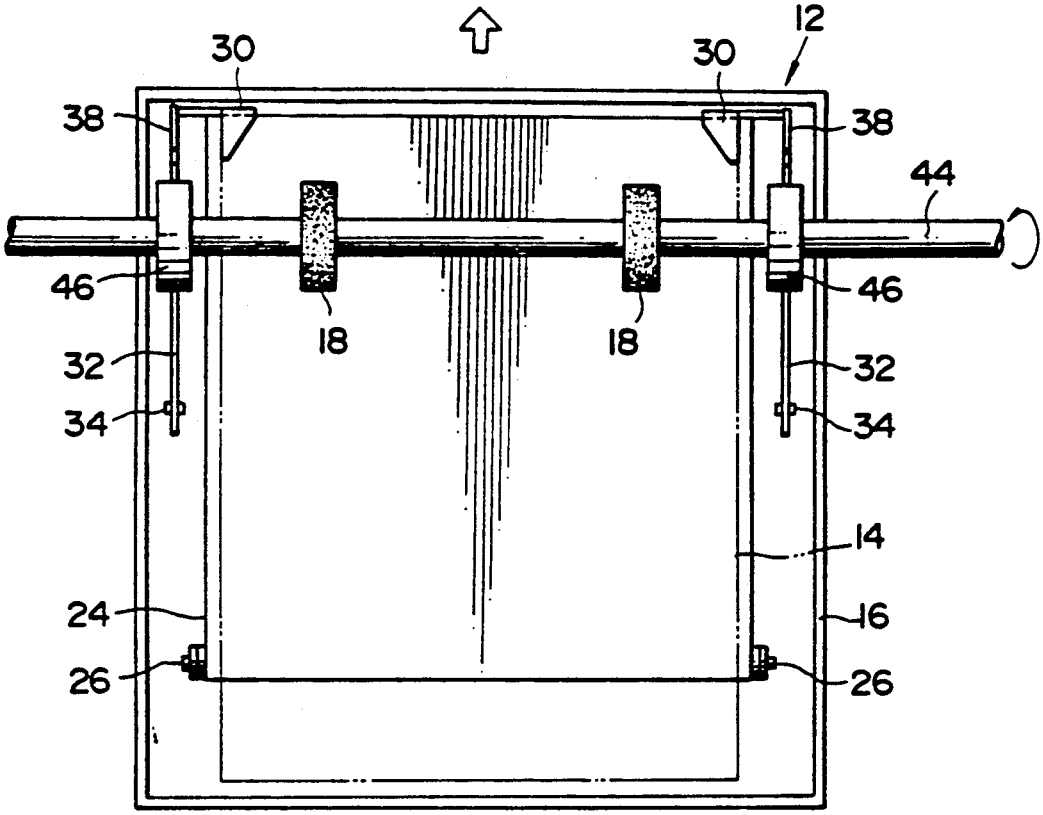
FIG. 1 is a plane view showing essential parts of a sheet feeding device accordong to one embodiment of the present invention.
Figure 2:
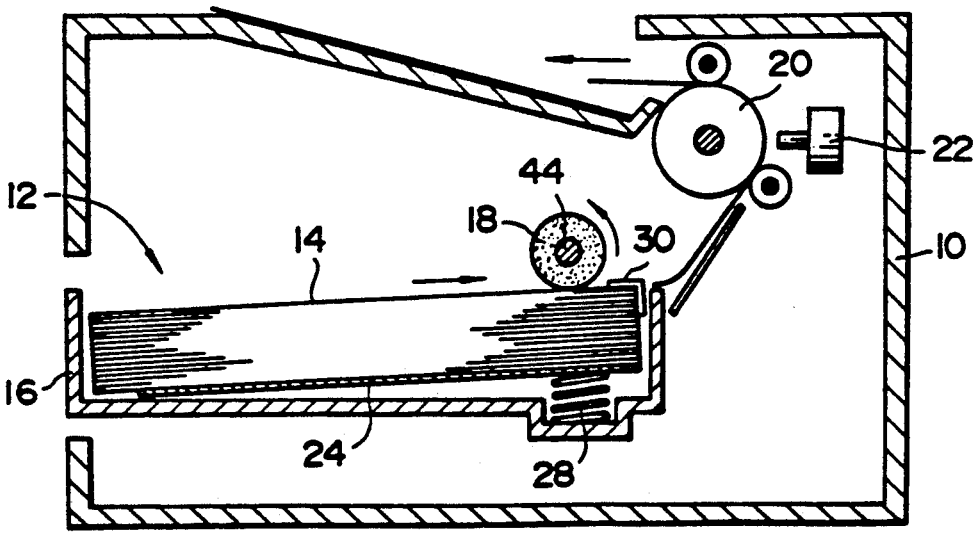
FIG. 2 is a section schematically showing the entire printer including the sheet feeding device of FIG. 1.

FIG. 1 is a plane view showing essential parts of a sheet feeding device according to the present invention and FIG. 2 schematically shows a sectional view of the printer equipped with a cassette-type sheet feeding device of FIG. 1. A cassette case 16 retaining print sheet (referred to as sheet hereafter) 14 in a stacked state is inserted in a case inserting compartment 12 provided in a printer box 10. A feed roller 18 transfers the top sheet of sheets 14 placed in a cassette case 16 to a printer unit near a platen 20. A print head 22 in the printer unit then effects printing. Stacked sheets 14 which has been printed is line-fed and discharged by means of rotation of the platen 20.

The cassette case 16 is a flat box with an upward opening and has a lifting plate 24 in its bottom as a lifting member, on which the bundle of sheets 14 is placed. As shown in FIG. 1, the lifting plate 24 is rotatably mounted by two pins 26 on the cassette case 16 at the rear end thereof in the direction in which the cassette case 16 is inserted (indicated by an outlined arrow). This lifting plate 24 is biased in the direction to approach the feed roller 18 by a compression spring 28 as shown in FIG. 2, so that the top sheet of the sheets 14 is pressed against the feed roller 18 by means of the resilient force of the compression spring 28.

A pair of separator lugs 30 is arranged at the top corners of the sheets 14 at the front end in the inserting direction. As shown in FIG. 1, these separator lugs 30 are located so as to be engaged with each corner at both the front and the top sides thereof, and are integrally formed at the end of lug supporting arms 32 mounted on both sides of the sheets 14. Each separator lug 30, when viewed sideways, consists of a vertical part in contact with the upper sheets of the sheets 14 at the front side and a horizontal part in contact therewith at the top side. The horizontal part is of a triangle shape having a slope inside in its plan view. The rear ends of the both lug support arms are carried by pins 34, 34 for rotation relative to the cassette case 16, whereby each separator lug is supported movably in the direction of stacking the sheets 14.

Figure 3:
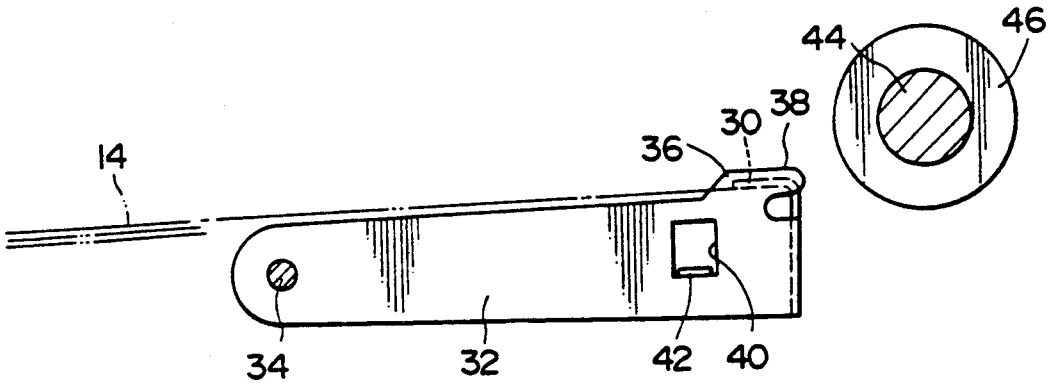
FIGS. 3, 4 and 5 are views explaning the press-down operation of the sheet feeding device when a case is loaded.

As shown in FIG. 3, each lug support arm 32 has an upward projection 36. The front end of the projection 36 in the cassette loading direction is rounded and the part behind the rounded end portion horizontally extends over a given length, leading to a sloped rear end of this projection. These parts form a contact portion 38.

The two lug support arms 32 are biased upwardly by the biasing force of the spring 28 which is exerted on them via the separator lugs 30 as shown in FIG. 2. However, since a stopper 42 is inserted in a rotation restricting hole 40 provided in each lug support arm 32, the upward rotation of the lug support arms 32 is stopped at the position where the bottom edge of the hole 40 abuts against the stopper 42.

As shown in FIG. 1, the feed rollers 18, which are mounted in the case inserting compartment 12 of the printer body 10 as described above, are arranged in a pair at an equal inside distance from each side of the sheets 14. These feed rollers 18 are fixed on a roller shaft 44 traversing the case inserting compartment 12 at a right angle to the case inserting direction. The roller shaft 44 is rotated by a sheet feed motor which is not shown.

A pair of press down rollers 46 are mounted rotatably around the roller shaft 44 as press down operating elements. These press down rollers 46 have the equal diameter to that of the feed rollers 18, and are situated in the area outside the separator lugs 30; i.e. at a certain outside distance from each side of the sheets 14 so that it is adapted to engage with the contact portion 38 of the lug support arms 32. In this case, the two lug support arms 32 are extended outward from the separator lugs 30 in the direction along the width of the sheets 14 by a given length and thereafter are bent at right angles to reach the pin 34.

Now, operation of the sheet feeding device will be described below.

Figure 4:
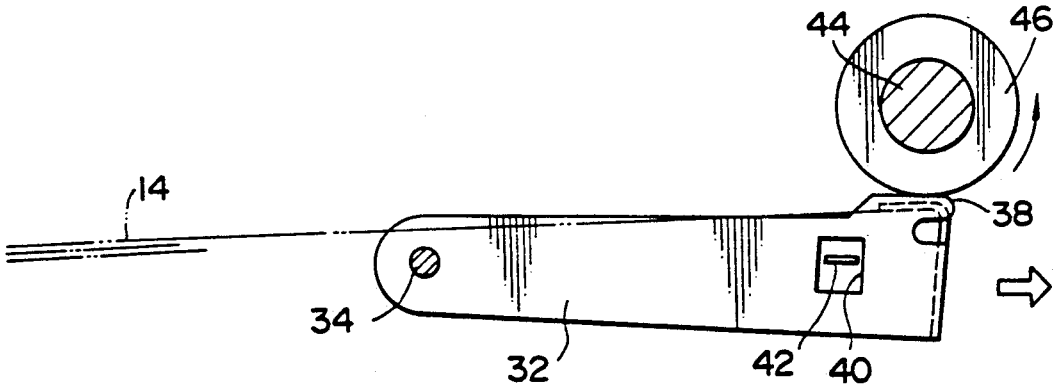
Figure 5:
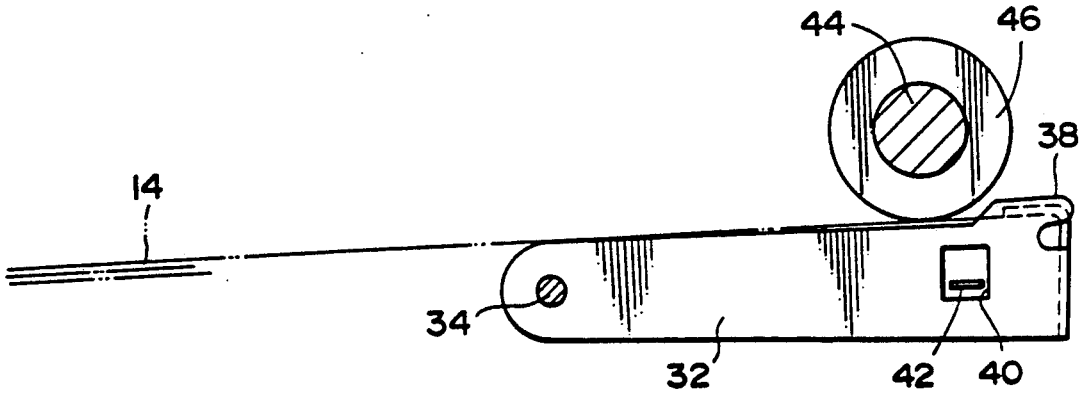

Movements of the cassette case 16 in the course of inserting operation are illustrated in FIGS. 3, 4 and 5. In these figures, the lug support arm 32 is representively illustrated with indication of the cassette case 16 omitted.

At the first step of the insertion shown in FIG. 3, the sheets 14 is biased upward by the spring 28 (FIG. 2) and the lug support arm 32 is retained in the highest level within the range restricted by the stopper 42. At this time, the contact portion 38 is located with a certain distance above the bottom position of the press down roller 46 in the path of its movement.

At the next step, as shown in FIG. 4, with further insertion of the cassette case 16, the contact portion 38 of the lug support arm 32 touches the press down roller 46, and then the press down roller 46 presses down the lug support arm 32 against the biasing force by the spring 28, while rolling over the contact portion 38 around the roller shaft 44. Thereby, the front area of the top sheet of sheets 14 passes under the feed rollers 18 without touching them.

At the final step where the insertion of the cassette case 16 is completed as shown in FIG. 5, the contact of the press down roller 46 with contact portion 38 is discontinued. Subsequently, the lug support arm 32 is lifted upward by the spring 28 and the top sheet of sheets 14 is pressed against the feed rollers 18 to become ready for feeding. Consequently, creases that might be caused by contact of the top sheet of sheets 14 with the feed roller 18 are prevented.

As the feed rollers 18 rotate, the top sheet of sheets 14 is transferred forward by means of a friction force. At this time, advancement of the sheets 14 is stopped by the separator lugs 30 at the front corners of the sheets 14 and, as a result, the front end of the sheets 14 is flexibly curved. When the curvature exceeds a certain extent, only the top sheet of sheets 14 is separated from each separator lug 30 to be allowed to advance. During such deformation, the both corners of the sheets 14 will be flexibly lifted. The press down rollers 46 is located outside the sides of the sheets 14 to avoid disturbance of such lifting.

In this embodiment, since the press down rollers 46 are brought into rolling contact with the contact portions 38 of the lug support arms 32, there will be a minimum contact resistance between the two parts to ensure smooth insertion of the cassette case 16.

When the cassette case 16 is removed, the lug support arm 32 is temporarily pressed down during withdrawal as shown by FIG. 5, 4 and 3 in reverse to the course mentioned above, so that contact between the top sheet of sheets and the feed roller 18 is avoided similarly to the case of insertion.

Instead of the configuration in which the contact portion is formed on part of the lug support member which extends toward the roller shaft, it is also possible to use the conventional shape of lug support member as it is as a contact portion, while this portion is made to contact with the press-down operating member which radially projects from the roller shaft.

The press-down operating member is not necessarily a radial projection at the roller shaft but can be, in an alternative arrangement, the existing circumferential surface of the roller shaft itself, with which the contact portion extended from the lug support member is touched.

An another embodiment of the invention is now described with reference to FIGS. 6 through 11.

Figure 6:
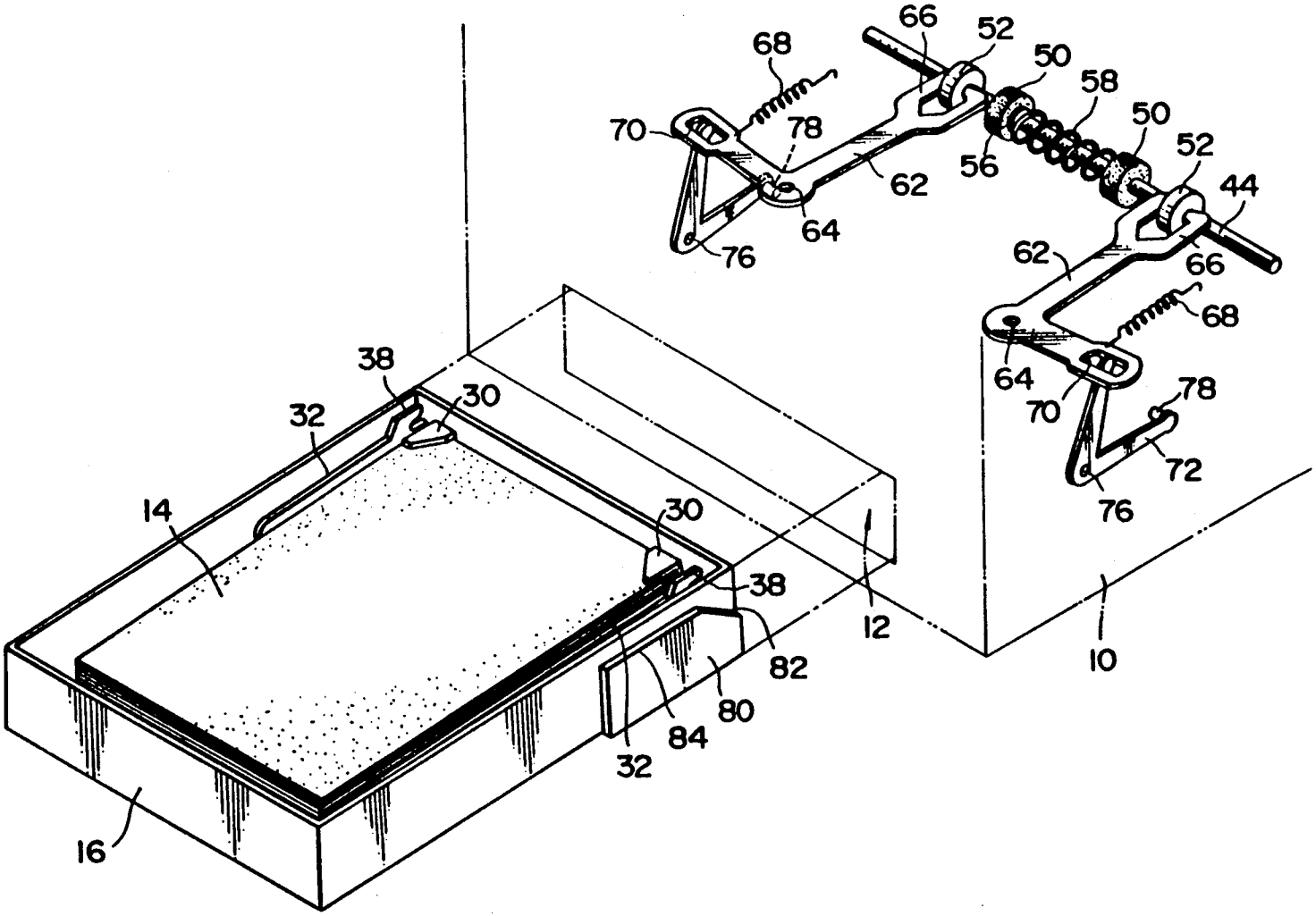
FIG. 6 is a perspective view showing essential parts of a sheet feeding device according to another embodiment of the present invention.
Figure 9:
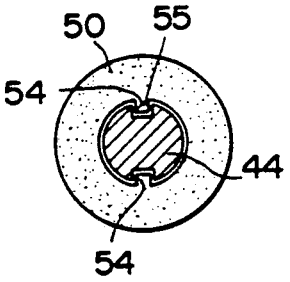
FIG. 9 is a sectional view showing the roller shaft including the feed roller.

As shown in FIG. 6, a roller shaft 44 has a pair of feed rollers 50 mounted thereon at a certain distance from each other and a pair of press down roller 52 mounted outside of either feed roller 50. The two feed rollers 50 are movable in the axial direction of the roller shaft 44 while being prohibited from relative rotation around the shaft axis. As shown in FIG. 9, the roller shaft 44 is provided with two axially extending guide grooves 54 with a phase displacement of 180 degrees from each other. Engaging projections 55 formed on the inner surface of the feed rollers 50 are slidably fitted in those grooves, so that the rotary drive power of the roller shaft 44 is transmitted to the feed roller 50, while it is allowed to axially move.

Figure 7:
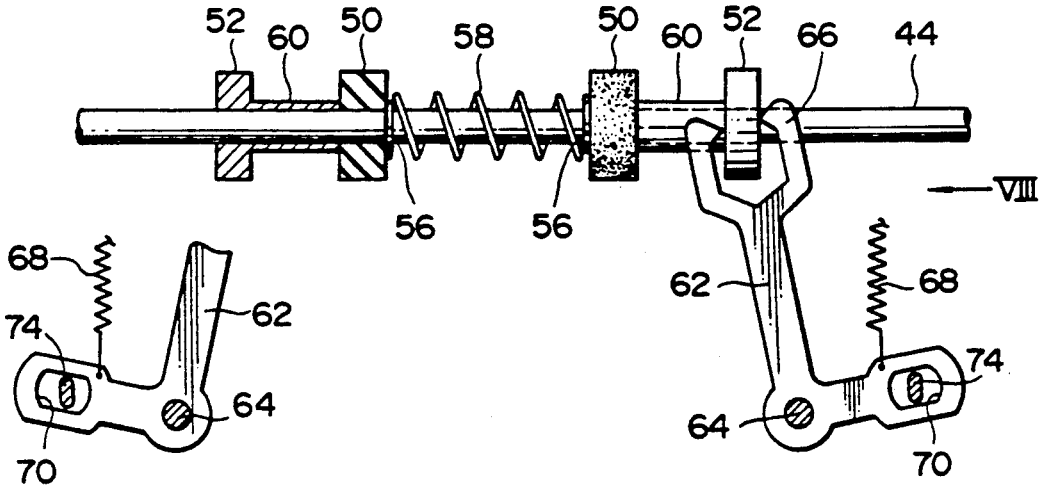
FIG. 7 is a plane view showing the roller shaft and its associated parts incorporated in the sheet feeding device of FIG. 6.

As shown in FIG. 7, the approaching distance between the two feed rollers 50 is restricted by two stopper rings 56 fitted around the roller shaft 44 at a selected distance from each other. These feed rollers 50 are biased to be apart from each other by means of a compression spring 58 provided with a certain compression load.

Figure 10:
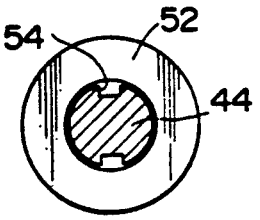
FIG. 10 is a sectional view of the roller shaft including the press down rollers.

The press down roller 52 mounted outside of each feed roller 50 integrally have a cylindrical portion 60 extending toward the adjacent feed roller 50 and the end of the cylindrical portion 60 contacts the side surface of the feed roller 50, thereby restricting the distance between the feed roller 50 and the adjacent press down roller 52. These press down rollers 52 are movable in the axial direction of the roller shaft 44 and are engaged with the roller shaft 44 to be rotatable around the roller shaft 44. That is, as shown in FIG. 10, the internal surface of the press down roller 52 is not provided with a projection like the projection 55 of the feed roller 50, whereby its free rotation is allowed.

As shown in FIGS. 6 and 7, first L-shaped bell crank levers (referred to as first levers hereinafter) 62 is provided for each press down roller 52. These first levers 62 are mounted by pins 64 on the printer body 10 to be rotatable within a horizontal plane. A forked yoke portion 66 provided at one end of each first lever 62 moves in an arc substantially along the axis of the roller shaft 44. These first levers 62 are biased by means of tension springs 68 born between the printer body 10 and the first levers 62 with a selected tension load so that the yoke portion 66 faces inward (toward the feed rollers 50). The resilience of the tension spring 68 is made to be greater than that of the aforementioned compression spring 58, so that each feed roller 50 is usually retained in the position touching the stopper ring 56 usually with the compression spring 58 compressed. The yoke portion 66 formed at one end of each first lever 62 holds the press down roller 52 between the forked legs, allowing rotation of the press down roller 52.

Figure 8:
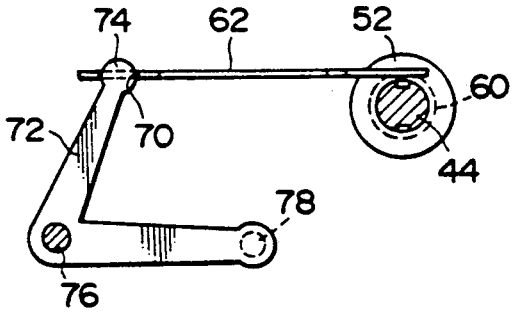
FIG. 8 is a view taken in the direction indicated by an arrow VIII of FIG. 7.

At the other end of the first lever 62 provided is a coupling hole 70. As shown in FIG. 8, a connecting portion 74 formed in one end of a second bell crank lever (referred to as second lever hereafter) 72 is inserted in the coupling hole 70. This second lever 72 is carried by pin 76 on the printer body 10 to be rotatable within a vertical plane. The other end of the second lever 72 is provided with a horizontally inwardly protruding pin portion 78. This pin portion 78 works as a cam follower, as will be mentioned later.

Figure 11:
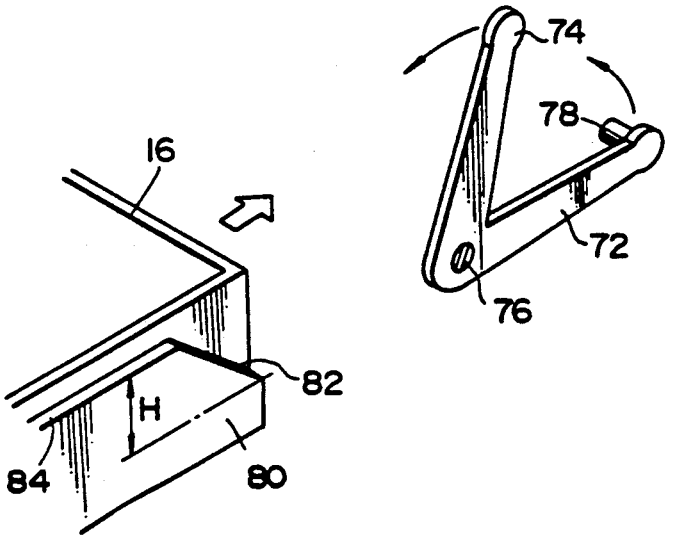
FIG. 11 is a view explaning the cassette loading operation.

As shown in FIGS. 6 and 11, a cam portion 80 is symmetrically provided on both sides of the cassette case 16. This cam portion 80 includes an inclined plane 82 ascending from front to rear end of the case 16 and a horizontal surface 84 continuously extending backward from the top end of the inclined surface 82. The inclined surface 82 is provided in a position adapted to contact the pin portion 78 of the aforementioned second lever 72 in the inserting direction and the rotation angle of the second lever 72 is to be determined by the height "H" of the inclined surface 82.

More than one cassette cases are to be used for different sheet sizes, so that the distance between the separator lug pair 30 and the difference between the two lug support arms 32 are determined in accordance with the width of the sheet retained therein. That is, the smaller the sheet width, the smaller the distance between the lug support arms 32 are determined. The cam portion 80 of the cassette case 16 is set to an equal position regardless of changes in sheet width, whereas the height "H" of the inclined surface 82 differs among different sheet widths. That is, the greater the sheet width, the greater the height "H" of the included surface 82 are determined.

Operation is now described as follows.

When the cassette case 16 is loaded into the case insertion compartment 12, the inclined surface 82 of the cam portion 80 is brought into contact with the pin portion 78 of the second lever 72 substantially at an initial stage of the insertion stroke to push up the pin portion 78 along the inclined surface 82 as shown in FIG. 11. As a result, the second lever 72 is rotated counterclockwise in the drawing through a certain angle.

At this time, as shown in FIGS. 6 and 7, the first levers 62 are angularly moved outwardly of each other overcoming the biasing force of the tension spring 68 so that the press down rollers 52 are moved outward by way of the yoke portions 66. With this movement of the press down rollers 52, the feed rollers 50 subject to the biasing force of the compression springs 58 are moved along with the press down rollers 52 so that the distance between the feed rollers 50 and the distance between the press down rollers 52 are both changed at the same time.

Here, the changed distance between the feed rollers 50 is set to be at a certain inward distance from the both sides of the sheet in accordance with the width of the sheets 14, while the distance between the press down rollers 52 is set to correspond to the distance between the contact portions 38 of the lug support arms 32.

Such displacement in the cassette 16 inserting direction is thus converted to the axial movement of the roller shaft 44 by means of contact between the inclined surface 82 and the pin portion 78 as well by combined action of the levers 72 and 62 to enable the positions of the feed rollers 50 and the press down rollers 52 in dependence on the sheet width in use. The levers 62 and 72, pin portion 78 and cam portion 80 altogether form the distance adjusting mechanism.

When the cassette case 16 is further pushed in so that the pin portion 78 of the lever 72 rides over the horizontal surface 84 of the cam portion 80, the position of the press down rollers 52 and pertaining distances are then kept constant.

When this condition is established, as in the embodiment according to the above first embodiment, i.e., as shown in FIGS. 3 to 5, the contact portion 38 of the lug support arm 32 is brought into contact with the press down roller 52 (46) thus moved for temporary moving down thereof, so that contact between the feed roller 50 and the top sheet of sheets 14 is avoided.

The mechanism can handle a greater sheet width because displacement of the feed roller 50 and the press down roller 52 increases with an increasing height "H" of the inclined surface 82 as mentioned above. On the other hand, there is no need of providing a cam portion 80 on the cassette case 16 retaining sheet of a minimum width to set the minimum distance (shown in FIG. 7) of the rollers 50 and 52 to the minimum width of the sheet.

Since rotatable round rollers 46 and 52 are used as operating elements for pressing down the roller shaft 44 in the embodiments of the first and second embodiments described above, it would be readily understood that a contact resistance with the lug support arms is limited to a minimum. Besides, this ensures an optimum contact state with the lug support member 32 in whatever rotary phase of the roller shaft 44. In particular, while it may be possible to integrally form a projection for pressing down on part of the circumference of the roller shaft 44, it will then be necessary to control the home position for positioning the projection at a specific rotary phase, which is not required by the round rollers.

Figure 12:
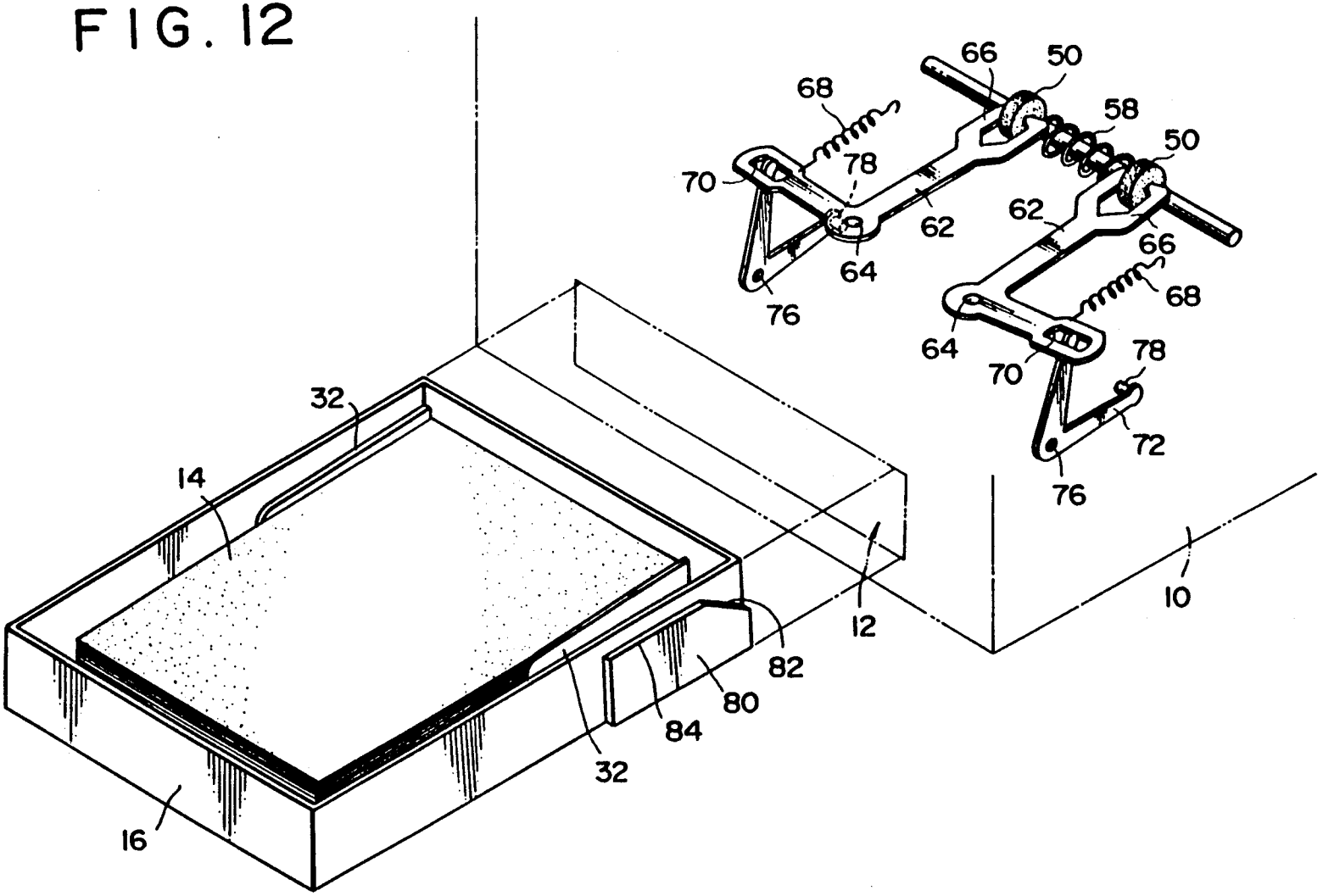
FIG. 12 is a perspective view showing essential parts of a sheet feeding device according to still another embodiment of the present invention.

As a still another embodiment, as shown in FIG. 12, it may be considered that a mechanism for adjusting the distance between the feed rollers in accordance with sheet widths is available by the arrangement such that the pair of press down rollers 52 and the contact portion 38 in FIG. 6 are omitted with the yoke portion 66 of the first lever 62 brought into engagement with the feed roller 50. In this embodiment, a pair of rollers 52 are used as a feed rollers as well as a pair of pressure members for pressing down the cassette case 16.

What is claimed is:

1. A sheet feeding device provided in a recording device, comprising a case member insertable in said recording device in a sheet feeding direction, for holding a plurality of recording sheets in a stacked state, a pair of spaced apart feed rollers coaxially provided on a shaft member located above the stacked sheets for feeding the sheet located on the top of the stacked sheets in said feed direction, the spacing interval between said rollers being variable, said sheet feeding device further comprising:

indicating means including a pair of cam portions on both sides of said case member for indicating the width of the sheets to be stacked; and, vary means for interacting with said cam portions to vary the interval of length of said pair of rollers proportionally to the width of said sheets in response to the indication of width of the sheets.

2. The sheet feeding device according to claim 1, further comprising a pair of cam follower members movable along said pair of cams, and wherein said vary means comprises a pair of connect members for respectively being movable in accordance with a movement of each of said pair of cam follower members and a pair of transmission portions provided on predetermined positions of said pair of connect members, for transmitting a movement of each of said pair of cam follower members to said pair of feed rollers.

3. A sheet feeding device provided in a recording device, comprising a case member having vertical sidewalls for holding a plurality of recording sheets in a stacked state said case member being insertable in said recording device in a sheet feeding direction, a pair of spaced apart feed rollers coaxially provided on a shaft member located above the stacked sheets, for feeding the sheet located on the top of the stack in said feed direction, the spacing interval between said rollers being variable said sheet feeding device further comprising:

a pair of sheet separation members provided on said case member having a pair of nail portions for separating the sheet having been located on the top of the stacked sheets in accordance with a sheet feed operation of said pair of feed rollers;

first control means for controlling the stacked sheets in such a manner that the sheet located on the top of the stacked sheets is brought into contact with said pair of feed rollers;

second control means for controlling said first control means so as not to be operated if a positional relationship between said case member and said recording device becomes a predetermined state; and third control means including a pair of cam portions formed on both vertical sidewalls of said case member, said cam portions having slopes and heights proportional to a width of the sheets to be stacked and vary means for interacting with said cam portions to vary the spacing interval of said pair of feed rollers along said shaft member in accordance with the width of the sheets stacked in said case.

4. The sheet feeding device according to claim 3 wherein said pair of sheet separation members are movable in a direction along which the sheets are stacked, and wherein said second control means comprises depress means located with a predetermined relationship with said case member, for depressing said pair of sheet separation members.

5. The sheet feeding device according to claim 4 wherein said depress means comprises a depress member for supplying a depress force to said pair of sheet separation members, and wherein said predetermined state is that said depress member and said pair of sheet separation members are adapted to be brought into contact with each other.

6. The sheet feeding device according to claim 5 wherein said depress member comprises a pair of rollers coaxially located with said pair of feed rollers on said shaft member, and wherein said pair of sheet separation members are adapted to be brought into and out of contact with said pair of rollers.

7. The sheet feeding device according to claim 6 wherein said depress member pair of rollers are provided outwardly of both side edge of the stacked sheets.

8. The sheet feeding device according to claim 6 wherein said depress member pair of rollers are rotatably supported on said shaft member.

9. The sheet feeding device according to claim 6 which further comprises a pair of separation members respectively provided between one of said pair of feed rollers and one of said pair of rollers, for separating the feed roller and the roller with a predetermined interval of length.

10. The sheet feeding device according to claim 5 wherein said third control means comprises indicating means provided on said case member for indicating the width of the sheets to be stacked and vary means for varying the spacing interval of said depress member based upon an indication of said indicating means.

11. The sheet feeding device according to claim 10 wherein said vary means comprises two pairs of bell-crank members for respectively being movable in a vertical and a holizontal directions in accordance with a movement of each of said pair of cam follower members and a pair of yorke portions provided on one of said pairs of bell-crank members being horizontally movable, for transmitting a movement of each of said pair of cam follower members to said pair of rollers.

* * * * *